US007188675B2

(12) United States Patent
Reynolds

(10) Patent No.: US 7,188,675 B2
(45) Date of Patent: Mar. 13, 2007

(54) FINGER BOOT BASKET

(75) Inventor: James Scott Reynolds, Houston, TX (US)

(73) Assignee: M-I L.L.C., Houston, TX (US)

( * ) Notice: Subject to any disclaimer, the term of this patent is extended or adjusted under 35 U.S.C. 154(b) by 130 days.

(21) Appl. No.: 11/036,691

(22) Filed: Jan. 14, 2005

(65) Prior Publication Data

US 2006/0157249 A1 Jul. 20, 2006

(51) Int. Cl.
*E21B 31/08* (2006.01)

(52) U.S. Cl. ..... 166/311; 166/99

(58) Field of Classification Search ..... 166/311, 166/99; 294/86.11

See application file for complete search history.

(56) References Cited

U.S. PATENT DOCUMENTS

| | | | | |
|---|---|---|---|---|
| 2,700,567 | A | 1/1955 | Fortenberry | |
| 2,796,285 | A * | 6/1957 | True | 294/86.11 |
| 2,834,300 | A | 5/1958 | Brock | |
| 2,927,644 | A * | 3/1960 | Caldwell | 166/99 |
| 2,997,108 | A * | 8/1961 | Sievers et al. | 166/222 |
| 3,067,821 | A | 12/1962 | Crooks | |
| 3,198,256 | A * | 8/1965 | Kirby, II | 166/99 |
| 3,500,933 | A * | 3/1970 | Burba, Jr. et al | 166/311 |
| 4,059,155 | A | 11/1977 | Greer | |
| 4,111,262 | A | 9/1978 | Duncan | |
| 4,194,567 | A * | 3/1980 | Marais | 166/311 |
| 4,828,026 | A | 5/1989 | Nelson | |
| 5,944,100 | A | 8/1999 | Hipp | |
| 6,176,311 | B1 * | 1/2001 | Ryan | 166/99 |
| 6,250,387 | B1 | 6/2001 | Carmichael | |
| 6,341,653 | B1 | 1/2002 | Firmaniuk | |
| 6,607,031 | B2 * | 8/2003 | Lynde et al. | 166/99 |
| 6,951,251 | B2 * | 10/2005 | Penisson | 166/312 |

OTHER PUBLICATIONS

PCT International Search Report dated May 4, 2006 for Application No. PCT/US2006/000764 (4 pages).

* cited by examiner

*Primary Examiner*—Hoang Dang
(74) *Attorney, Agent, or Firm*—Osha Liang LLP

(57) ABSTRACT

A boot basket for retrieving debris from a well bore, and a method for retrieving debris from said well bore. The boot basket includes a mandrel having an internal wall and an external wall. The mandrel is connectable to a work string. The boot basket further includes a basket having an inner wall and an outer wall, wherein the basket is disposed on the mandrel such that an annular space exists between the inner wall of the basket and the external wall of the mandrel. A plurality of fingers is pivotally mounted and movable between a first open position and a second closed position. Each of the plurality of fingers blocks a portion of the annular space existing between the inner wall of the basket and the external wall of the mandrel when in the second closed position.

17 Claims, 7 Drawing Sheets

FINGER BOOT BASKET

BACKGROUND OF INVENTION

A well bore may be drilled in the earth for various purposes, such as hydrocarbon extraction, geothermal energy, or water. After a well bore is drilled, the well bore is typically lined with casing. The casing preserves the shape of the well bore as well as provides a sealed conduit for fluid to be transported to the surface.

In general, it is desirable to maintain a clean well bore to prevent possible complications that may occur from debris in the well bore. For example, accumulation of debris can prevent free movement of tools through the well bore during operations, as well as possibly interfere with production of hydrocarbons or damage tools. Potential debris includes cuttings produced from the drilling of the well bore, metallic debris from the various tools and components used in operations, and corrosion of the casing. Smaller debris may be circulated out of the well bore using drilling fluid; however, larger debris is sometimes unable to be circulated out of the well. Also, the well bore geometry may affect the accumulation of debris. In particular, horizontal or otherwise significantly angled portions in a well bore can cause the well bore to be more prone to debris accumulation. Because of this recognized problem, many tools and methods are currently used for cleaning out well bores.

One type of tool known in the art for collecting debris is the junk catcher, sometimes referred to as a junk basket, junk boot, or boot basket, depending on the particular configuration for collecting debris and the particular debris to be collected. The different junk catchers known in the art rely on various mechanisms to capture debris from the well bore. A common link between most junk catchers is that they rely on the movement of fluid in the well bore to capture the sort of debris discussed above. The movement of the fluid may be accomplished by surface pumps or by movement of the string of pipe or tubing to which the junk catcher is connected. Hereinafter, the term "work string" will be used to collectively refer to the string of pipe or tubing and all tools that may be used along with the junk catchers discussed herein. For describing fluid flow, "uphole" refers to a direction in the well bore that is towards the surface, while "downhole" refers to a direction in the well bore that is towards the distal end of the well bore.

A junk catcher is disclosed in U.S. Pat. No. 4,111,262 issued to Duncan, which is incorporated herein by reference in its entirety. An embodiment disclosed by Duncan is shown in FIG. 1. The particular configuration shown in FIG. 1 is commonly referred to as a junk boot or boot basket because of the boot 102 that is disposed on the tool body 101. The junk boot shown in FIG. 1 includes an upper connection 108 and a lower connection 109 for connecting to other components in the work string (not shown). The junk boot may be deployed along any portion of the work string, but is generally near the downhole end (i.e. deepest in the well bore) in order to collect debris that cannot be circulated out of the well. The junk boot shown in FIG. 1 functions through the use of fluid (not shown) pumped through the work string that goes through the internal cylindrical wall 113 and exits through tools located below the junk boot. The fluid, along with any suspended debris, travels uphole towards the surface in the annular space between the boot 102 and the casing wall 120. At the location of the boot 102, flow is restricted because of the large outer diameter of the boot 102. The restricted area creates faster flow. As the fluid passes the boot 102, it suddenly decelerates because of the larger annular space between the outer diameter of the tool body 101 and the casing wall 120. This causes some of the debris 105 (especially larger and denser debris) to settle out of the fluid and enter into the opening 106 at the top of the boot 102. The junk boot continues to function in this manner until the boot 102 is filled with the debris 105.

Another type of junk catcher is disclosed in U.S. Pat. No. 4,059,155 issued to Greer, which is incorporated herein by reference in its entirety. An embodiment disclosed by Greer is shown in FIGS. 2A and 2B. The particular configuration shown in FIGS. 2A and 2B is typically referred to as a reverse-circulating junk basket. The junk basket shown in FIG. 2 includes an upper body 206, a debris chamber 201, and a lower body 209. The upper body 206 has a connection 208 for connecting to a work string (not shown). At the end of the lower body 209, the junk basket includes a mill shoe 210, which can be used with rotation to break up debris or provide a core sample to be trapped in the debris chamber 201. Without explaining any additional valves and mechanisms used for reverse-circulation, the concept works by jetting fluid (not shown) through downward holes 212, which cause the fluid to exit the junk basket and flow downhole between the outside diameter of the junk basket and the well bore wall or casing if present (not shown). When the fluid reaches the downhole end of the junk basket, the fluid turns uphole and enters the lower body 209. This is referred to as "reverse-circulation" because fluid typically flows downhole through the center of a tool and uphole outside of the tool.

When the fluid turns uphole, it carries debris 105 into the debris chamber 201. Two sets of fingers 205 are disposed below the debris chamber 201 in the lower body 209. The fingers 205 are biased towards a closed position as shown in FIG. 2B. Hinges 215 allow the fingers 205 to pivot upward into an open position with fluid flow to allow debris 105 to pass. The fluid continues to flow uphole to the upper body 206 as the debris 105 is filtered out in the debris chamber 201. The fluid is jetted out of the upper body through upward holes 211 (shown as dashed lines) and into the well bore. When fluid flow ceases or is sufficiently reduced, the fingers 205 return to a closed position, trapping the debris 105 within the debris chamber 201. The size of the debris 105 collected within the debris chamber 201 is determined by the spacing between the fingers 205. Smaller gaps between the fingers 205 allow for the collecting of smaller debris. Similar reverse-circulating junk catchers may use flapper valves in place of fingers 205 in order to catch small debris such as sand and gravel. Some reverse-circulating junk catchers may use extended debris chambers made of tubing in order to collect greater amounts of debris. The debris 105 being collected, the pumping equipment being used, and various well parameters affect the total length of the debris chamber, and, as a result, the total amount of debris that may be collected.

Junk boots, such as the one shown in FIG. 1, are limited in the outer diameter of the junk boot 102 because fluid (and debris 105 suspended therein) must still be able to flow around the junk boot 102. This limits the amount of debris that can be collected within the junk boot 102 per foot of axial length. To collect additional debris 105, the junk boot 102 must be lengthened, or additional junk catchers may be used in the work string. A known issue with reverse-circulating junk catchers, such as the one shown in FIGS. 2A and 2B, is that they must be positioned near the end of the work string in order to be effective in collecting debris. Further, only one reverse-circulating junk catcher may be used in a work string.

SUMMARY OF INVENTION

In one aspect, the disclosed subject matter related to a boot basket for retrieving debris from a well bore. The boot basket includes a mandrel having an internal wall and an external wall. The mandrel is connectable to a work string. The boot basket further includes a basket having an inner wall and an outer wall, wherein the basket is disposed on the mandrel such that an annular space exists between the inner wall of the basket and the external wall of the mandrel. A plurality of fingers is pivotally mounted and movable between a first open position and a second closed position. Each of the plurality of fingers blocks a portion of the annular space existing between the inner wall of the basket and the external wall of the mandrel when in the second closed position.

In another aspect, the disclosed subject matter relates to a boot basket for retrieving debris from a well bore. The boot basket includes a mandrel having an internal wall and an external wall. The mandrel is connectable to a work string. The boot basket includes a basket having an inner wall and an outer wall, wherein the basket is disposed on the mandrel such that an annular space exists between the inner wall of the basket and the external wall of the mandrel. The boot basket further includes a plurality of fingers biased towards a closed position and disposed proximate a downhole end of the basket. The plurality of fingers blocks a substantial portion of the annular space existing between the inner wall of the basket and the external wall of the mandrel when in the closed position. In response to fluid flow in an uphole direction, the plurality of fingers moves towards an open position.

In another aspect, the disclosed subject matter relates to a method for collecting debris from a well bore. The method includes connecting a boot basket to a work string. The boot basket includes a mandrel having an internal wall and an external wall. The mandrel is connectable to a work string. The boot basket includes a basket having an inner wall and an outer wall, wherein the basket is disposed on the mandrel such that an annular space exists between the inner wall of the basket and the external wall of the mandrel. The boot basket further includes a plurality of fingers biased towards a closed position and disposed proximate a downhole end of the basket. The plurality of fingers blocks a substantial portion of the annular space existing between the inner wall of the basket and the external wall of the mandrel when in the closed position. In response to fluid flow in an uphole direction, the plurality of fingers moves towards an open position. The method further includes tripping the boot basket into the well bore and circulating fluid through the work string, wherein at least some of the fluid exits the work string downhole from the boot basket. The boot basket is tripped out of the well bore to retrieve the debris.

In another aspect, the disclosed subject matter relates to a boot basket for retrieving debris from a well bore. The boot basket includes a mandrel having an internal wall and an external wall. The mandrel is connectable to a work string. The boot basket includes a basket having an inner wall and an outer wall, the basket having a plurality of radial holes formed therein, wherein the basket is disposed on the mandrel such that an annular space exists between the inner wall of the basket and the external wall of the mandrel. A screen is disposed along the inner wall of the basket. A diverter is disposed proximate an uphole end of the basket. A lower support piece is disposed proximate a downhole end of the basket. The lower support piece has axial openings formed therein to allow fluid to flow into the annular space existing between the inner wall of the basket and the external wall of the mandrel. An upper support piece is disposed proximate the uphole end of the basket. The upper support piece has axial openings formed therein to allow fluid to flow out of the annular space existing between the inner wall of the basket and the external wall of the mandrel. The boot basket further includes a plurality of fingers biased towards a closed position and disposed proximate a downhole end of the basket. The plurality of fingers blocks a substantial portion of the annular space existing between the inner wall of the basket and the external wall of the mandrel when in the closed position. In response to fluid flow in an uphole direction, the plurality of fingers moves towards an open position. The basket is axially contained on the mandrel while being free to rotate relative to the mandrel.

Other aspects and advantages of the invention will be apparent from the following description and the appended claims.

DETAILED DESCRIPTION

In one aspect, the disclosed subject matter relates to a junk catcher. More specifically, the subject matter relates to a boot basket type junk catcher having a plurality of fingers disposed in a lower portion of the boot basket that allow substantially unrestricted flow in an uphole direction, but restrict debris suspended in the fluid from flowing in a downhole direction in order to collect the debris within a basket disposed on a mandrel.

Figure 1:
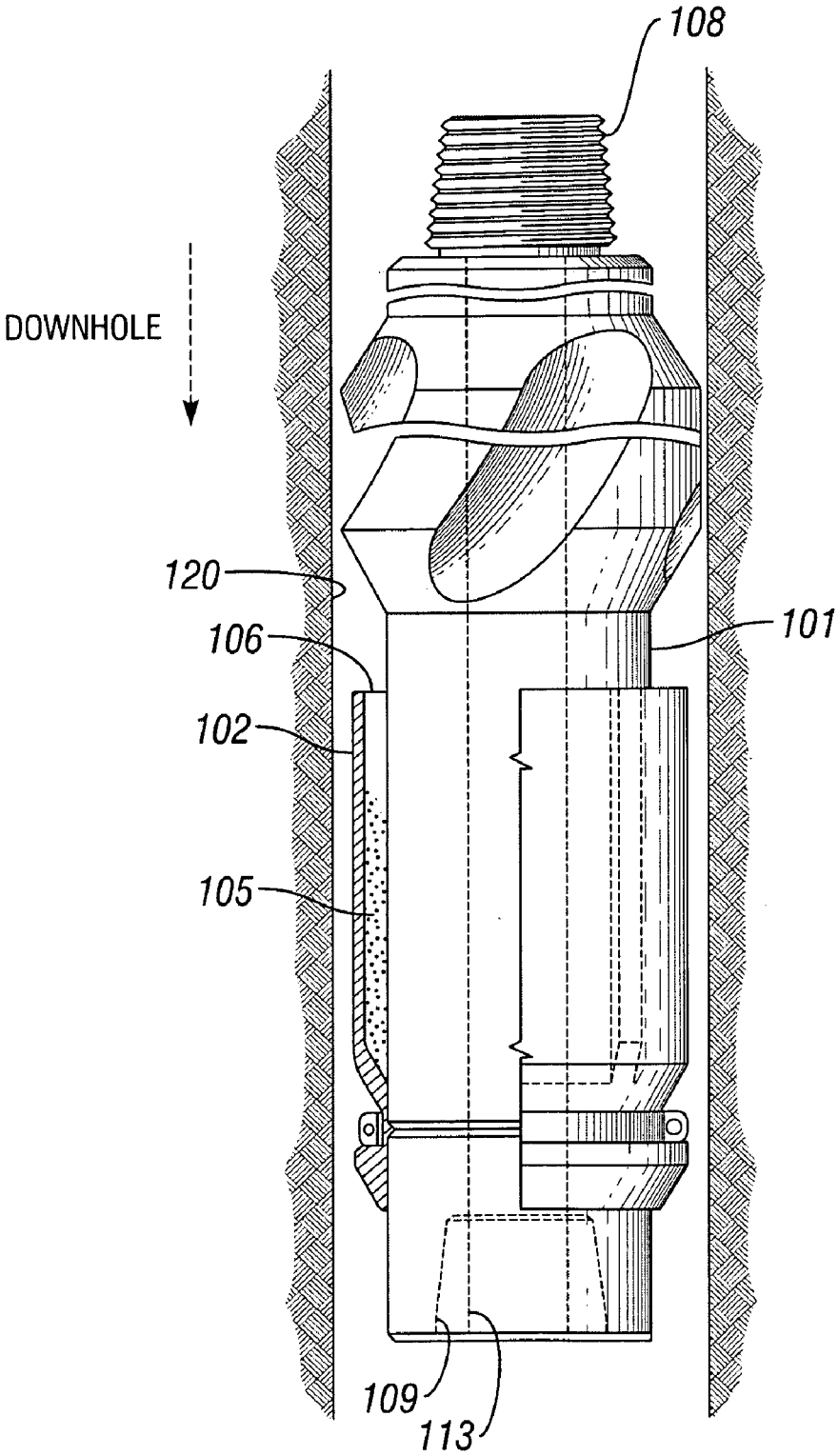
FIG. 1 (Prior Art)
FIG. 1 shows a prior art boot basket.
Figure 2A:
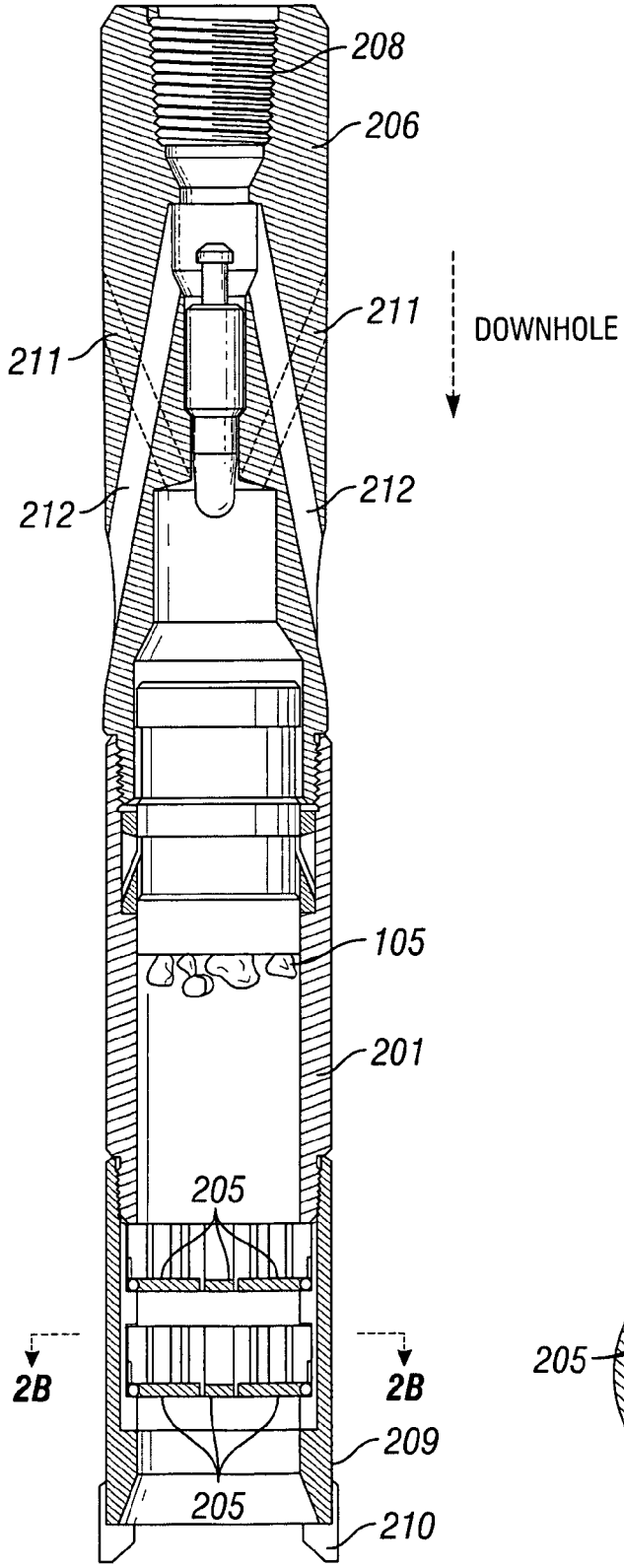
FIG. 2A (Prior Art)
FIGS. 2A and 2B show a prior art reverse-circulating junk catcher.
Figure 2B:
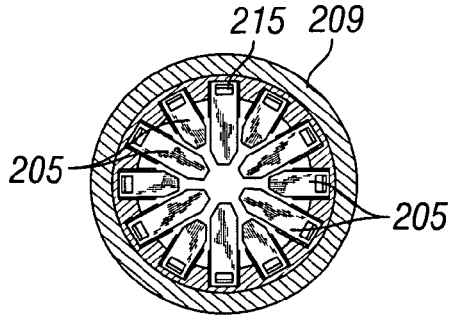
FIG. 2B (Prior Art)
Figure 3:
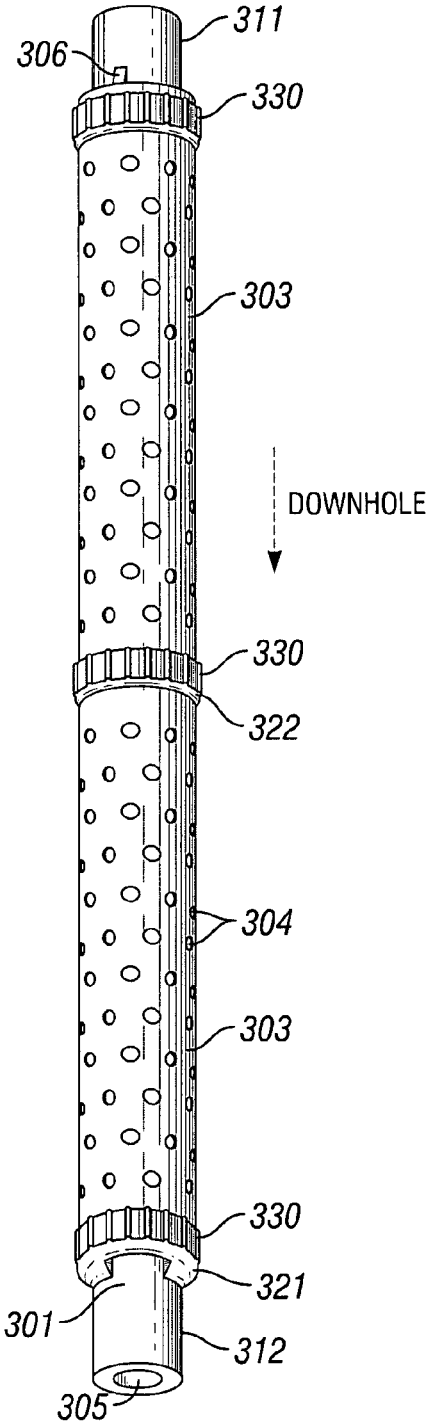
FIG. 3 shows a perspective view of a boot basket in accordance with one embodiment of the present invention.
Figure 4A:
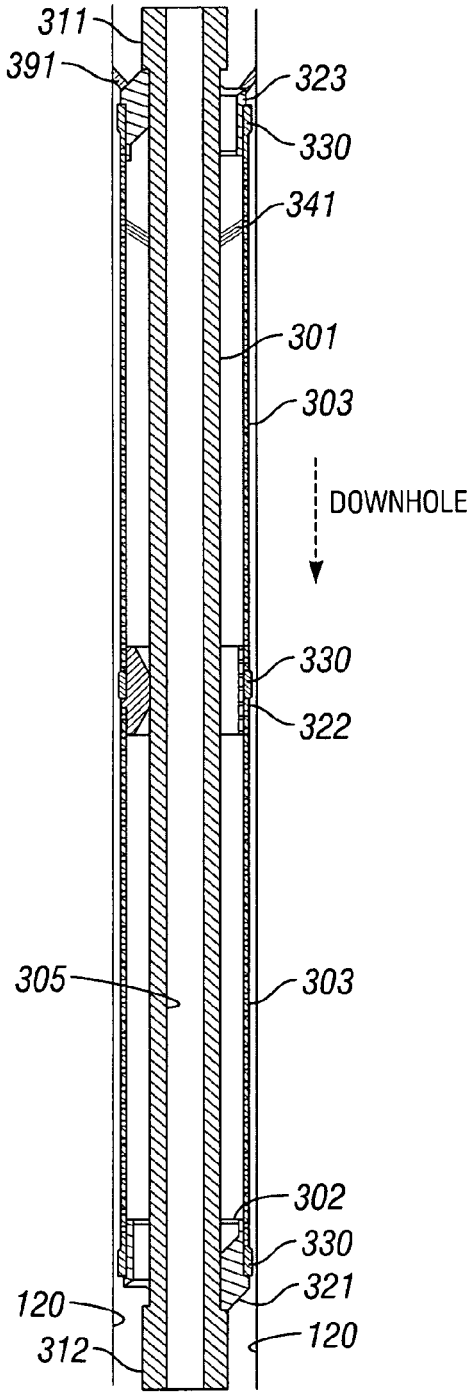
FIG. 4A–4C show cross-sections of the boot basket shown in FIG. 3.
Figure 4B:
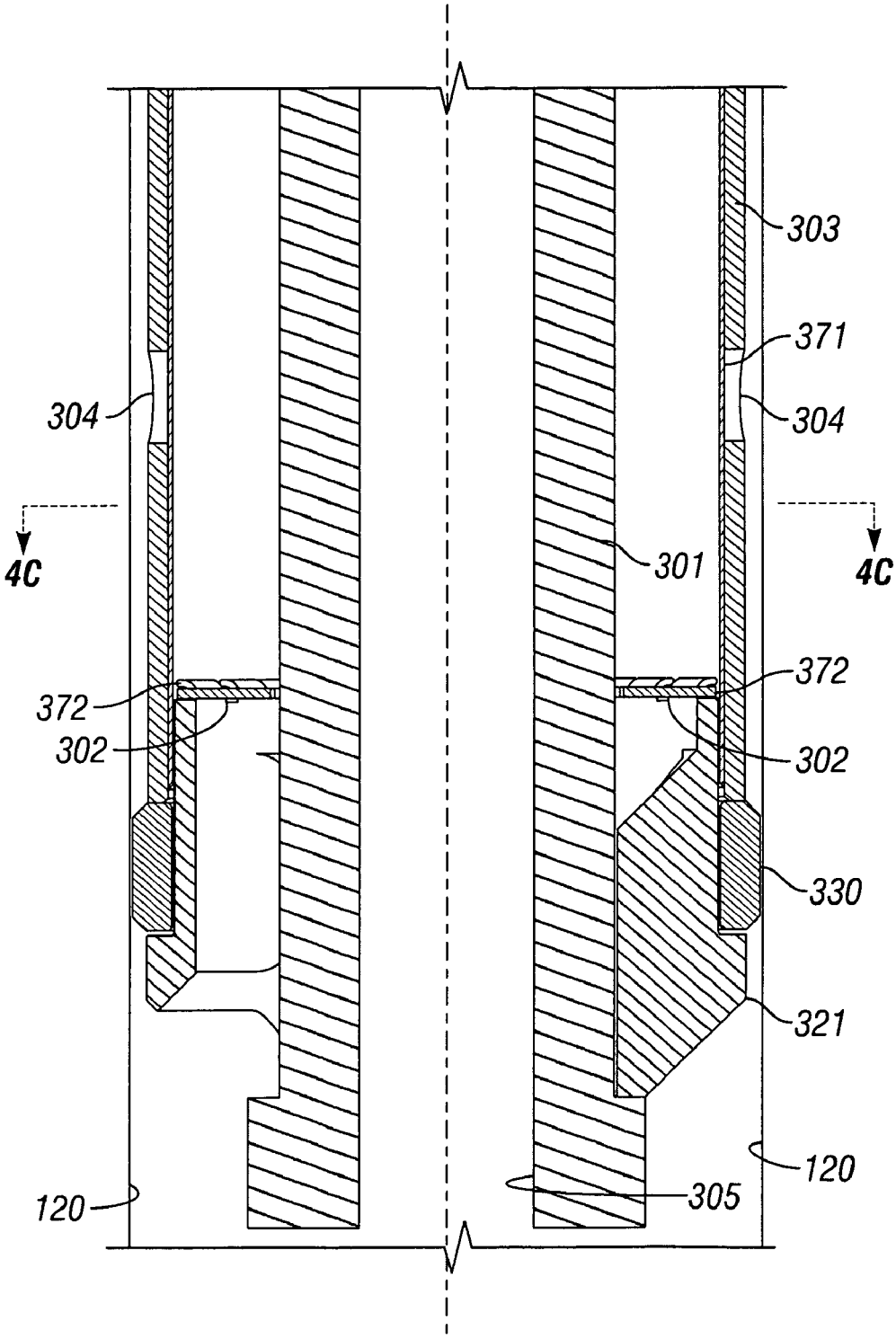
Figure 4C:
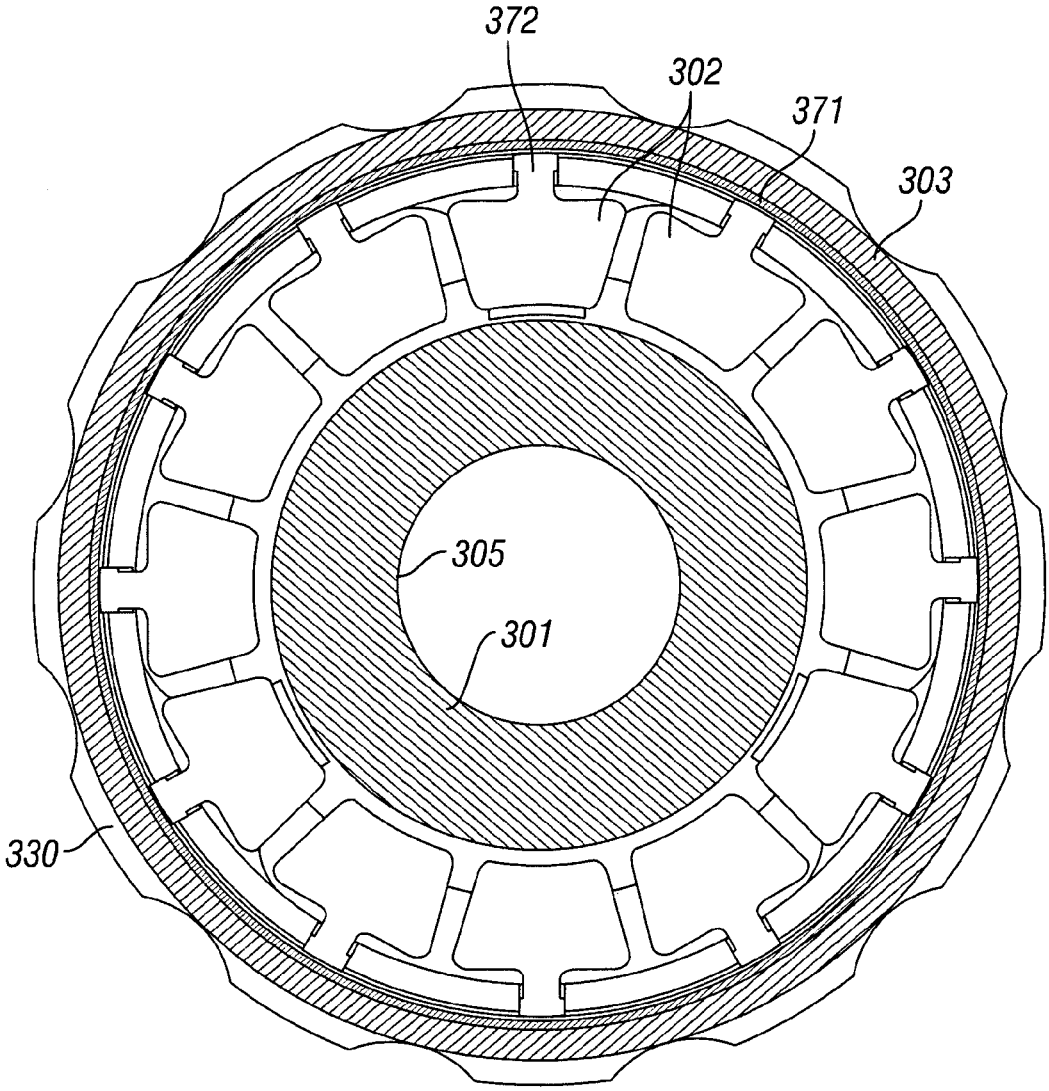

FIG. 3 shows a perspective view of a boot basket in accordance with one embodiment of the present invention. FIGS. 4A, 4B, and 4C are cross sections of the boot basket shown in FIG. 3. Not all of the features of the boot basket are visible in any one of the Figures. Accordingly, reference will be made to the appropriate Figure for the feature being described. Numbering of features is consistent between each of the Figures.

As shown in FIGS. 3 and 4A, the boot basket includes a mandrel 301 having a connection 311 on the upper end thereof in order to connect to a work string (not shown). The mandrel 301 may also have a connection 312 formed on the downhole end thereof to connect to additional components below the boot basket on the work string. The mandrel 301 includes an internal cylindrical wall 305 in fluid communication with the work string. Disposed on the mandrel 301, are a lower end support piece 321, two baskets 303, an intermediate support piece 322, and an upper support piece 306. Each of the support pieces 321, 322, and 306 have openings in the axial direction to allow fluid to flow through with minimal restriction. Embodiments of the present invention may include stabilizers 330 at one or more locations to centralize the boot basket within the well bore. 120. Those having ordinary skill in the art will appreciate that embodiments of the present invention do not require more than one basket, nor do they require stabilizers and support pieces 321, 322, and 306.

FIGS. 4B and 4C show cross sections of the downhole end of the boot basket in order to make some of the features of the embodiment more visible. Fingers 302 are disposed in a circumferential pattern (seen clearly in FIG. 4C) near the bottom of the basket 303. The fingers 302 are biased towards the closed position when there is little or no uphole fluid flow. To collect debris, fluid may be circulated downhole through the inner cylindrical wall 305 and exit at a location below the basket 303. As the fluid flows uphole, most of the fluid is forced to flow into the basket 303 because of the minimal annular space between the outer wall of the basket 303 and the well bore 120. The fluid flows into the basket through the axial openings in the lower support piece 321. In this embodiment, the fingers 302 are attached in a hinge-like manner at their radially outermost extent to the lower support piece 321 at the attachment points 372. While the weight of the fingers 302 causes some bias towards the substantially closed position, the attachment of the fingers may include springs (not shown) to further bias the fingers 302 towards the closed position. As used herein, the "closed position" refers to the fingers 302 when they block a substantial portion of the annular space existing between the inner wall of the basket 303 and the external cylindrical wall of the mandrel (see FIG. 4C) such that axial fluid flow through the basket 303 is restricted. The "open position" refers to the fingers 302 when they are forced at least partially open to allow uphole fluid flow through the basket 303.

Figure 5A:
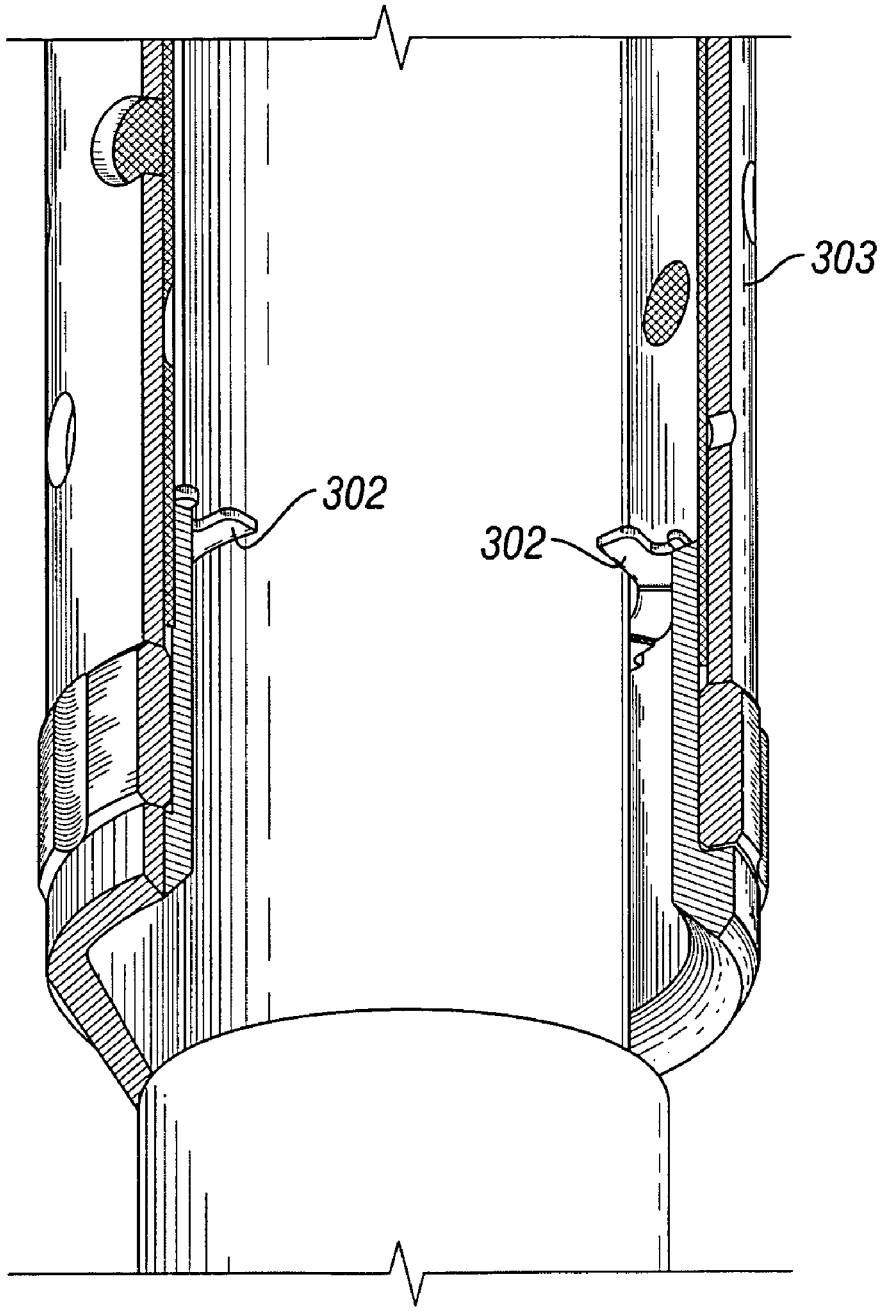
FIGS. 5A and 5B show perspective views of the downhole end of the boot basket with the fingers in a closed position and an open position, respectively.
Figure 5B:
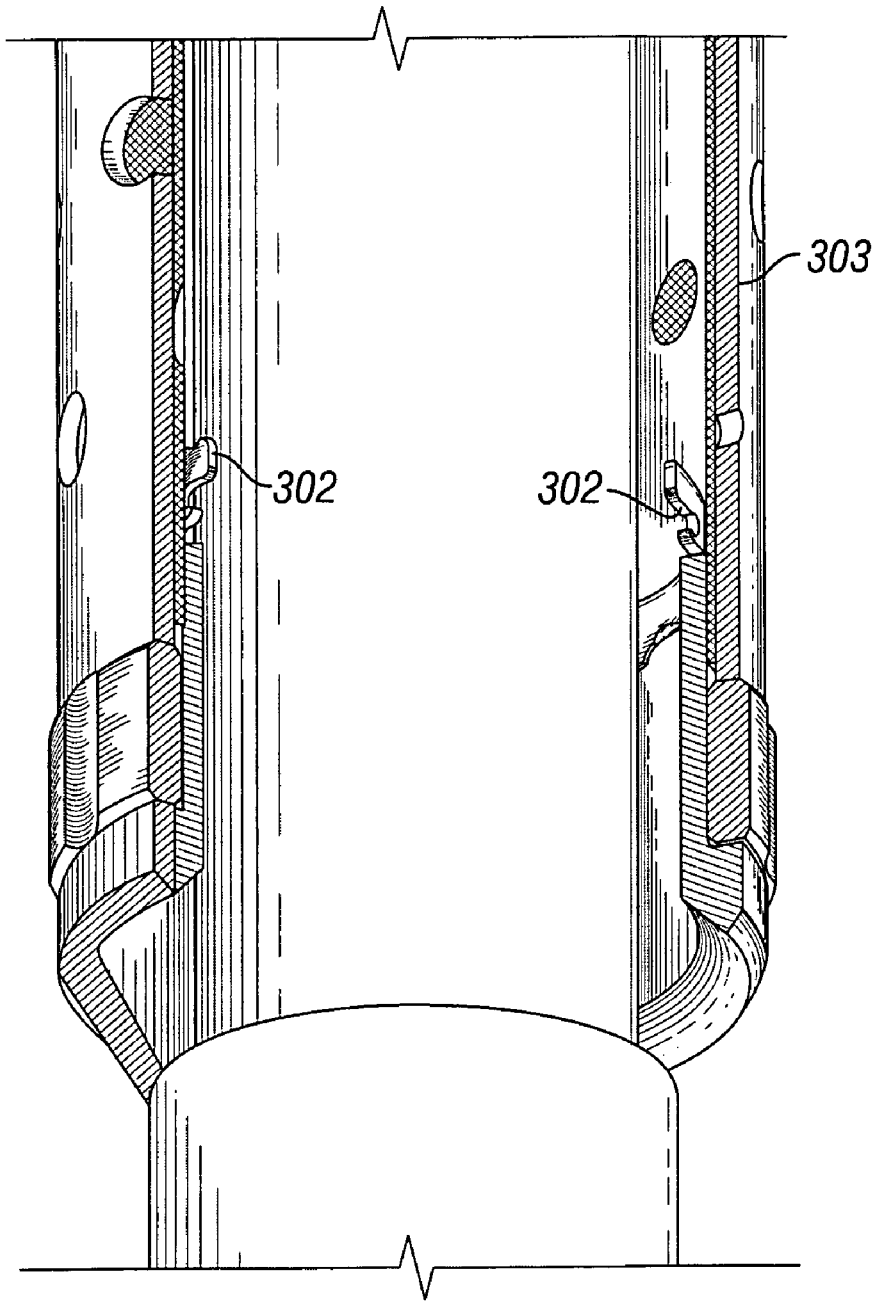

The function of the boot basket is illustrated in FIGS. 5A and 5B, which are perspective views of the downhole end of the boot basket with a portion of the basket 303 removed in order to view the movement of the fingers 302. FIG. 5A shows the fingers 302 in the closed position, while FIG. 5B shows the fingers 302 in the fully open position. In another embodiment, the fingers 302 may be attached on their radially innermost extent. In another embodiment, the fingers may be made such that they are flexible at the attachment point and do not require a hinge-like attachment. Those having ordinary skill in the art will appreciate that there are various ways to attach the fingers 302 and bias them towards the closed position, which may be used without departing from the scope of the invention.

At a minimum, the boot basket includes a basket 303 disposed on a mandrel 301, with a plurality of fingers 302 positioned to be able to block at least some debris from moving downhole after having entered the basket 303. The basket 303 has at least a bottom opening and an opening at a location uphole from the fingers 302. Additional features may be desired depending on the application for which the boot basket is being used, in particular the type of debris to be collected. The embodiments described with respect to FIGS. 3, 4A, 4B, 4C, 5A, and 5B are suitable for collecting a mixture of large and small debris. Additional features shown in those Figures are described below.

In the particular disclosed embodiment, the basket 303 has a pattern of radial holes 304 formed therein (see FIG. 3). The holes 304 allow fluid to pass exit the basket 303. The pattern of radial holes 304 may be more desirable than a single opening at the uphole end of the basket 303 because the basket 303 is less likely to be plugged with collected debris with the pattern of radial holes 304. One embodiment may further include a screen 371 (see FIGS. 4B, 5A, and 5B) disposed on the inner cylindrical wall of the basket 303. The screen 371 serves to filter out smaller debris such as sand and gravel that may escape through the radial holes 304.

In the illustrated embodiment, the basket 303 is disposed between two ends of the mandrel 301. The ends of the mandrel 301 have a larger outer diameter than the inner diameter of the support pieces 321, 322, 330, which traps the basket 303 axially while allowing the basket 303 to be free to rotate relative to the mandrel 301. Various manufacturing methods may be used to axially trap the basket 303 while allowing the basket 303 to rotate. For example, the support pieces may be threaded on their inner surfaces and thread over an end of the mandrel 301. Alternatively, one of the ends of the mandrel 301 may be welded on after the installation of the basket 303 and other components onto the mandrel 301. In another embodiment, one of the ends of the mandrel 301 may have a thread with a major diameter smaller than the inner diameter of the support pieces 321, 322, 330 allowing the basket 303 to be installed on the mandrel 301. After installation of the basket 303, a sub (not shown) having a mating thread to the mandrel 301 may be installed to trap the basket 303. The sub may include a connection for connecting to additional components in the work string, or, alternatively, have openings to allow fluid to exit the mandrel 301. While allowing the basket 303 to rotate freely is not required by all embodiments of the invention, this function may be desirable in many uses. For example, wear and potential damage to the basket 303 may be reduced if milling (which requires rotation of the work string) is performed because the basket 303 would stay somewhat fixed relative to the well bore 120 while the mandrel 301 rotates with the work string.

Embodiments of the invention may be modular in their designs in order to allow for flexibility in their configurations. Various components may be installed on a given mandrel 301. For example, in the embodiment shown in FIG. 4A, two baskets 303 are disposed on the mandrel 301 with an intermediate support piece 322 and a stabilizer 330 disposed axially between the two baskets 303. In another embodiment, only one basket 303 may be disposed on the mandrel 301 with only a lower support piece 321 and a completely open uphole end.

Also shown in FIG. 4A is a brush 341 disposed between the inner wall of the basket 303 and the mandrel 301. The brush 341 may be a ring of fairly rigid metal wire that is closely spaced to collect larger debris such as rocks. Those having ordinary skill in the art will appreciate that the coarseness of the brush 341, as well as the material used, may vary depending on the debris to be collected without departing from the scope of the present invention. Further, the placement of the brush 341 along the mandrel 301 may vary. For example, in one embodiment, the brush 341 may be disposed proximate the uphole end of the basket 303 to prevent larger debris from exiting the basket 303 past the upper end support piece 323.

Embodiments of the invention may also include a diverter 391 disposed proximate the uphole end of the basket 303. The diverter 391 may be formed from rubber or other pliable material. The diverter 391 may have an outer diameter that is close to the inner diameter of the well bore 120. When the boot basket is pulled out ("tripped out") of the well bore 120, most of the debris that is left in the well bore 120 uphole from the boot basket will be diverted into the basket 303 allowing additional debris to be collected. Thus, some embodiments of the present invention may be able to collect debris while tripping out of the well bore 120.

Embodiments of the present invention provide one or more of the following advantages. The outer diameter of the basket disclosed above is only limited by the geometry of the well bore in which the boot basket will be used. Prior art junk boots are more restricted in the outer diameter of the boots because fluid and suspended debris must be able to pass between the boot and the well bore before being collected in the boot. Because the present invention directs fluid through the basket, only sufficient clearance for the boot basket to not get stuck in the well bore is required. This allows for a larger volume of debris to be collected per axial foot of basket. Further, larger debris may be collected in the disclosed basket because of the larger annular space between the inner wall of the basket and the outer wall of the mandrel.

Embodiments of the present invention may be configured to collect debris while being put into ("tripping in") the well bore, while stationary in the well bore with fluid circulating, and while tripping out of the well bore. This ability allows for debris to be collected at almost every phase of the trip in the well bore. This increases the likelihood of filling the basket to capacity with debris and allows for improved cleaning of the well bore. Further, by collecting debris while tripping out of the well bore, debris on the low side of a horizontal or otherwise angled section of the well bore may be collected in the basket.

The present invention may be deployed at any location in the work string. If the debris to be collected is near the bottom of the well bore, the boot basket may be disposed proximate the downhole end of the work string. Further, more than one boot basket may be deployed on a single work string. For example, one may be disposed proximate the downhole end of the work string, while another is disposed a couple of hundred feet uphole from the other boot basket. The uphole boot basket may be configured with a diverter to collect debris while tripping out, while the downhole boot basket is configured with one or more brushed within the basket to collect larger debris that is near the bottom of the well bore.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A boot basket comprising:

a mandrel having an internal wall and an external wall, the mandrel being connectable to a work string;

a basket having an inner wall and an outer wall, wherein the basket is disposed on the mandrel such that an annular space exists between the inner wall of the basket and the external wall of the mandrel; and a plurality of fingers biased towards a closed position are disposed proximate a downhole end of the basket, wherein the plurality of fingers blocks a substantial portion of the annular space existing between the inner wall of the basket and the external wall of the mandrel when in the closed position, wherein the plurality of fingers moves towards an open position in response to fluid flow in an uphole direction.

2. The boot basket of claim 1, wherein a plurality of radial holes are formed in the basket.

3. The boot basket of claim 2, further comprising:

a screen disposed along the inner wall of the basket.

4. The boot basket of claim 1, further comprising:

a brush disposed between the inner wall of the basket and the external wall of the mandrel.

5. The boot basket of claim 1, further comprising:

a lower support piece disposed proximate the downhole end of the basket, wherein the lower support piece has axial openings formed therein to allow fluid to flow into the annular space existing between the inner wall of the basket and the external wall of the mandrel; and an upper support piece disposed proximate an uphole end of the basket, wherein the upper support piece has axial openings formed therein to allow fluid to flow out of the annular space existing between the inner wall of the basket and the external wall of the mandrel, wherein the basket is axially contained on the mandrel while being free to rotate relative to the mandrel.

6. The boot basket of claim 5, wherein the plurality of fingers are attached to the lower support piece.

7. The boot basket of claim 5, further comprising:

a stabilizer on at least one of the lower support piece and the upper support piece.

8. The boot basket of claim 1, further comprising:

a diverter disposed proximate an uphole end of the basket.

9. The boot basket of claim 1, further comprising:

a second basket having an inner wall and an outer wall, wherein the second basket is disposed on the mandrel such that an annular space exists between the inner wall of the second basket and the external wall of the mandrel; and an intermediate support piece disposed axially between the basket and the second basket, wherein the intermediate support piece has axial openings formed therein to allow fluid to flow into the annular space existing between the inner wall of the second basket and the external wall of the mandrel.

10. A method of collecting debris from a well bore, the method comprising:

connecting a boot basket to a work string, wherein the boot basket comprises:

a mandrel having an internal wall and an external wall, the mandrel being connectable to the work string;

a basket having an inner wall and an outer wall, wherein the basket is disposed on the mandrel such that an annular space exists between the inner wall of the basket and the external wall of the mandrel; and a plurality of fingers biased towards a closed position are disposed proximate a downhole end of the basket, wherein the plurality of fingers blocks a substantial portion of the annular space existing between the inner wall of the basket and the external wall of the mandrel when in the closed position, wherein fluid flow in an uphole direction moves the plurality of fingers towards an open position;

tripping the boot basket into the well bore;

circulating fluid through the work string, wherein at least some of the fluid exits the work string downhole from the boot basket; and tripping the boot basket out of the well bore.

11. A boot basket comprising:

a mandrel having an internal wall and an external wall, the mandrel being connectable to a drill string on an uphole end and a downhole end;

a basket having an inner wall and an outer wall, the basket having a plurality of radial holes formed therein, wherein the basket is disposed on the mandrel such than an annular space exists between the inner wall of the basket and the external wall of the mandrel;

a screen disposed along the inner wall of the basket;

a diverter disposed proximate an uphole end of the basket;

a lower support piece disposed proximate a downhole end of the basket, wherein the lower support piece has axial openings formed therein to allow fluid to flow into the annular space existing between the inner wall of the basket and the external wall of the mandrel;

an upper support piece disposed proximate the uphole end of the basket, wherein the upper support piece has axial openings formed therein to allow fluid to flow out of the annular space existing between the inner wall of the basket and the external wall of the mandrel; and a plurality of fingers biased towards a closed position are disposed proximate a downhole end of the basket, wherein the plurality of fingers blocks a substantial portion of the annular space existing between the inner wall of the basket and the external wall of the mandrel when in the closed position, wherein fluid flow in an uphole direction moves the plurality of fingers towards an open position, wherein the basket is axially contained on the mandrel while being free to rotate relative to the mandrel.

12. The boot basket of claim 11, further comprising:

a brush disposed between the inner wall of the basket and the external wall of the mandrel.

13. The boot basket of claim 11, wherein the plurality of fingers are attached to the lower support piece.

14. The boot basket of claim 11, further comprising:

a stabilizer on at least one of the lower support piece and the upper support piece.

15. A boot basket comprising:

a mandrel having an internal wall and an external wall, the mandrel being connectable to a work string;

a basket having an inner wall and an outer wall, wherein the basket is disposed on the mandrel such that an annular space exists between the inner wall of the basket and the external wall of the mandrel; and a plurality of fingers, wherein each of the plurality of fingers is pivotally mounted and is movable between a first open position and a second closed position, wherein each of the plurality of fingers blocks a portion of the annular space existing between the inner wall of the basket and the external wall of the mandrel when in the second closed position.

16. The boot basket of claim 15, wherein a plurality of radial holes are formed in the basket.

17. The boot basket of claim 16, further comprising:

a screen disposed along the inner wall of the basket.

* * * * *